US012287136B1

(12) United States Patent
Signorino et al.

(10) Patent No.: US 12,287,136 B1
(45) Date of Patent: Apr. 29, 2025

(54) ICE-MAKING DEVICE

(71) Applicant: emz-Hanauer GmbH & Co. KGaA, Nabburg (DE)

(72) Inventors: Manfredi Signorino, Wackersdorf (DE); Benjamin Schemela, Schwarzenbach (DE); Georg Spießl, Altendorf (DE)

(73) Assignee: EMZ-HANAUER GMBH & CO. KGAA, Nabburg (DE)

( * ) Notice: Subject to any disclaimer, the term of this patent is extended or adjusted under 35 U.S.C. 154(b) by 0 days.

(21) Appl. No.: 18/826,666

(22) Filed: Sep. 6, 2024

(30) Foreign Application Priority Data

Oct. 11, 2023 (DE) ..... 102023127770.7

(51) Int. Cl.
*F25C 1/243* (2018.01)
*F25C 5/08* (2006.01)

(52) U.S. Cl.
CPC ..... *F25C 1/243* (2013.01); *F25C 5/08* (2013.01)

(58) Field of Classification Search
CPC ..... F25C 1/243; F25C 5/08
See application file for complete search history.

(56) References Cited

U.S. PATENT DOCUMENTS

2009/0308085 A1 12/2009 DeVos
2016/0097576 A1* 4/2016 Bartkowski ..... B01L 7/50 62/340

FOREIGN PATENT DOCUMENTS

WO 2020015707 A1 1/2020
WO 2022206851 A1 10/2022

* cited by examiner

*Primary Examiner* — James Sanders
(74) *Attorney, Agent, or Firm* — Hayes Soloway PC

(57) ABSTRACT

The invention relates to an ice-making device, in particular for a household appliance, comprising a receiving device for receiving at least one moulding element which is suitable and intended for moulding a piece of ice, wherein the at least one moulding element is designed in one piece and consists of an elastic material, wherein the at least one moulding element comprises an inlet opening for introducing a liquid and an ejection opening for ejecting a piece of ice.

11 Claims, 5 Drawing Sheets

ICE-MAKING DEVICE

CROSS-REFERENCE TO RELATED APPLICATIONS

This patent application claims the benefit of and priority to German Patent Application No. 102023127770.7, filed on Oct. 11, 2023, which is herein incorporated by reference in its entirety.

FIELD OF THE DISCLOSURE

The invention relates to an ice-making device, in particular for a household appliance.

SUMMARY

The invention relates to an ice-making device, in particular for a household appliance, comprising a receiving device for receiving at least one moulding element which is intended to mould an ice piece.

Such household appliances are, for example, refrigeration appliances of household equipment, in particular refrigerators, freezers or the like. Such appliances often include an ice-making device for providing ice pieces. By means of a liquid supply device, a liquid, usually water, is supplied to a moulding element in which the liquid then freezes. The moulding element determines the shape of the ice pieces. In addition to the already well-known ice cubes, there is an increased demand for ice pieces with other shapes. Spherical ice pieces are particularly favoured. However, moulding a spherical ice piece is difficult. Up to now, the moulding of such spherical ice pieces has involved a multi-part design of the moulding element, for example a two-part design. After freezing, the moulding element is opened, and the spherical ice piece is removed. However, such a design is technically complex and therefore cost-intensive.

The object of the present invention is to provide an ice-making device which overcomes the above-mentioned disadvantages. It is also the object of the invention to provide a household appliance which overcomes the above-mentioned disadvantages.

The problem is solved by the objects of the claims. The subclaims comprise preferred embodiments.

According to the invention, an ice-making device is provided, in particular for a household appliance, comprising a receiving device for receiving at least one moulding element which is suitable and intended for moulding a piece of ice, wherein the at least one moulding element is designed in one piece and consists of an elastic material, wherein the at least one moulding element comprises an inlet opening for introducing a liquid and an ejection opening for ejecting an ice piece.

The household appliance is preferably a refrigeration appliance of the household equipment, for example a refrigerator, a freezer or the like. The liquid introduced via the inlet opening is preferably water. However, other liquids suitable for consumption would also be conceivable. After the liquid has been introduced into the at least one moulding element, the liquid preferably freezes (i.e., a transition to the solid state of aggregation takes place). After the liquid is completely frozen, the moulded ice piece is ejected or removed from the ejection opening.

The ice-making device according to the invention comprises at least one one-piece moulding element. A one-piece embodiment is to be understood here as meaning that all sections of the moulding element are manufactured from a single and uniform part. This is to be distinguished from a one-piece design, in which all sections are not manufactured from a single and uniform part but are not only firmly but so intimately connected to one another that they do not appear as several sections joined to one another and in any case can no longer be detached from one another without destroying them in the process.

In contrast to the two-part moulding elements known from the prior art, the halves of which must be separated after moulding in order to be able to remove the ice piece, only a one-part moulding element is sufficient for the ice-making device according to the invention.

According to a preferred embodiment, the at least one moulding element comprises a wall element which encloses a receiving space. The receiving space is advantageously suitable and intended for forming an ice piece. Preferably, the shape of the ice piece is predetermined by the geometric design of the receiving space. The ice piece is essentially spherical or essentially in the shape of an ellipsoid or essentially in the shape of a polyhedron. Of course, other arbitrary shapes of the ice piece are also conceivable.

According to a further preferred embodiment, the at least one moulding element extends along a height axis (Z). Preferably, the inlet opening of the at least one moulding element is diametrically opposite the ejection opening of the at least one moulding element. It is advantageous that the inlet opening of the at least one moulding element lies along a height axis (Z) below the ejection opening of the at least one moulding element. Advantageous filling thus takes place along the height axis Z from below into the at least one moulding element. In the case of complete filling, the receiving space is filled up to the ejection opening without liquid escaping from the at least one moulding element.

Preferably, the inlet opening of the at least one moulding element can be fluidically connected to a liquid supply device. The liquid supply device is preferably arranged in the receiving device. Preferably, a valve device is provided which only allows the flow of liquid in the direction of or into the at least one moulding element. However, the flow of liquid out of the at least one moulding element is prevented by the valve device. The valve device can advantageously be arranged in the receiving device, in the liquid supply device and/or in the at least one moulding element. Preferably, the at least one moulding element comprises a hollow cylinder-like access section which encloses the inlet opening. This access section is advantageously arranged in a sealing manner on or in a receiving element of the receiving device.

According to a further preferred embodiment, at least one retaining element is provided, which is arranged on the at least one moulding element or is formed by the wall element of the at least one moulding element. Preferably, the at least one holding element is non-positively and/or positively connected to at least one counter-holding element of the receiving device. Preferably, the non-positive and/or positive connection between the at least one retaining element and the at least one counter-holding element prevents upward displacement of the at least one moulding element along the height axis (Z).

Preferably, the at least one holding element is arranged along a circumference of the wall element. It is advantageous that the at least one holding element is arranged at least partially circumferentially along a circumference of the wall element. Preferably, the at least one holding element is completely circumferential along the circumference of the wall element. However, it is also conceivable that spatially separated sections of the retaining element are arranged distributed along the circumference of the wall element.

Preferably, the holding element has a ring-like circumferential design and comprises a receiving groove in which the counter-holding element of the receiving device engages.

Advantageously, the at least one moulding element comprises a first section and a second section. Preferably, the first section is arranged along the height axis (Z) above the holding element. Preferably, the second section is arranged along the height axis (Z) below the holding element. Preferably, the holding element is arranged along the height axis (Z) essentially centrally with respect to the extension of the at least one moulding element. Due to such an advantageous design, the first section and the second section of the at least one moulding element have essentially the same extension along the height axis (Z).

According to a further preferred embodiment, the first section of the at least one moulding element comprises at least two expansion elements formed in a fold-like manner. Preferably, the first section of the at least one moulding element comprises at least three expansion elements formed in a fold-like manner. Preferably, the first section of the at least one moulding element comprises at least four-fold-like expansion elements. The at least two-fold-like expansion elements advantageously enable the ejection opening of the at least one moulding element to be enlarged. Preferably, the wall element has a slot-like opening in each of the at least two-fold-like expansion elements. It is advantageous that, in a first state, the at least two slot-like openings are tightly closed due to the elasticity of the wall element. The first state corresponds to the state in which the liquid is introduced into the receiving space and this then freezes to form the ice piece.

Preferably, an inner area of the wall element is intended to delimit the receiving space and thus provide the shape of the ice piece. In the first state, the shape of the inner region thus advantageously corresponds to the negative of the shape of the ice piece. Preferably, the inner region of the wall element is in contact with the ice piece in the first state. The slot-like openings can be advantageously spread by applying force. Such a spreading of the slot-like openings is made possible by the presence of the respective fold-like expansion elements.

Preferably, the fold-like expansion elements extend along the height axis (Z) starting from the at least one holding element at least up to a level in which the ejection opening is arranged. Preferably, the fold-like expansion elements are formed by the wall element. A one-piece moulding element that is easy to manufacture is thus provided.

According to a further preferred embodiment, an ejection element is provided, by means of which an ejection force can be applied along the height axis (Z) to the at least one moulding element and/or the ice piece. Preferably, the ejection force causes a piece of ice located in the at least one moulding element to be displaced upwards along the height axis (Z). Advantageously, the second section of the at least one moulding element is also deformed by the action of the ejection force. Preferably, the non-positive and/or positive connection of the holding element to the counter-holding element prevents a change in the position of the at least one moulding element due to the ejection force.

Preferably, the displacement of the ice piece along the height axis (Z) causes the slot-like openings to spread. This spreading of the slot-like openings enlarges the ejection opening so that the ice piece can be ejected from the at least one moulding element. In particular, for ice pieces with a spherical shape, a substantially closed moulding element is necessary in order to achieve a necessary negative shape for the ice piece. By advantageously providing the slot-like openings, the necessary negative shape can be made possible in the first state and at the same time a sufficiently large ejection opening can be provided in order to be able to remove the ice piece from the at least one moulding element.

Preferably, the clastic material of the at least one moulding element is designed in such a way that it returns to its original shape after the ice piece has been ejected and the ejection force has ceased. With such an advantageous return to the original shape, the slot-like openings are also brought together again in a sealing manner so that there is no longer any expansion and the receiving space is once again ready for the introduction of the liquid.

According to a further preferred embodiment, the elastic material is also designed in such a way that it maintains its elasticity even when exposed to cold temperatures, preferably down to −30° C. Furthermore, the elastic material is approved for handling foodstuffs, for example, FDA-compliant. Preferably, the elastic material of the at least one moulding element is a silicone.

According to a further advantageous embodiment, at least one heating element is provided on the first section of the at least one moulding element. Preferably, the at least one heating element can be activated before and/or during ejection of the ice piece. Such a heating element may, for example, be a resistance wire. Alternatively, a heating fan or the like could also be provided. The heating element can be used to detach the ice piece from the moulding element in the first section of the at least one moulding element by thawing it at least in sections. This makes it easier to open the ejection opening or to spread the slot-like openings.

The task is also solved by a household appliance comprising an ice-making device according to one of the described embodiments. The household appliance can be equipped with all the features already described above in the context of the ice-making device, either individually or in combination with one another, and vice versa.

The household appliance is preferably a refrigeration appliance of the household equipment, for example a refrigerator, a freezer or the like.

The household appliance advantageously comprises a control device which is connected to the ejection device, the liquid supply device and the heating element by means of signalling technology and controls the aforementioned components accordingly.

Further advantages, objectives and features of the present invention are explained with reference to the following descriptions of the attached figures. Similar components may have the same reference signs in the various embodiments.

DETAILED DESCRIPTION

Figure 1:
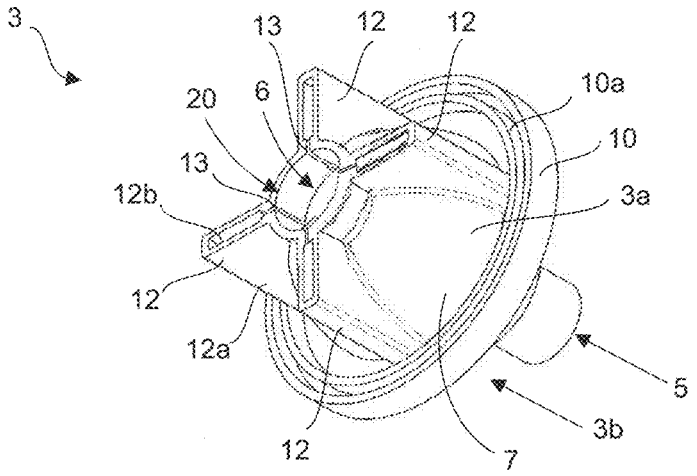
FIG. 1 a perspective view of a moulding element s according to one embodiment.

FIGS. 1-9 show an ice-making device 1, in particular for a household appliance 100, comprising a receiving device 2 for receiving at least one moulding element 3, which is suitable and intended for moulding a piece of ice 4, wherein the at least one moulding element 3 is designed in one piece and consists of an elastic material, wherein the at least one moulding element 3 comprises an inlet opening 5 for introducing a liquid and an ejection opening 6 for ejecting an ice piece 4.

The ice-making device 1 and the at least one moulding element 3 extend along a height axis Z, a longitudinal axis X and a width axis Y.

The ice-making device 1 can be installed in a household appliance 100, for example a refrigeration appliance for household use, in particular a refrigerator, a freezer or another household appliance.

Figure 2:
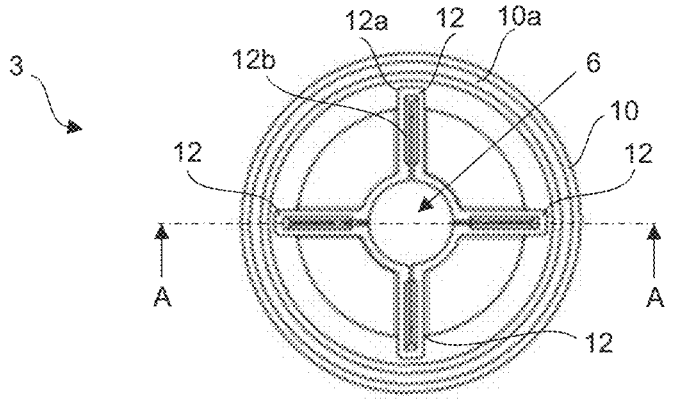
FIG. 2 a top view of a moulding element according to one embodiment.
Figure 3:
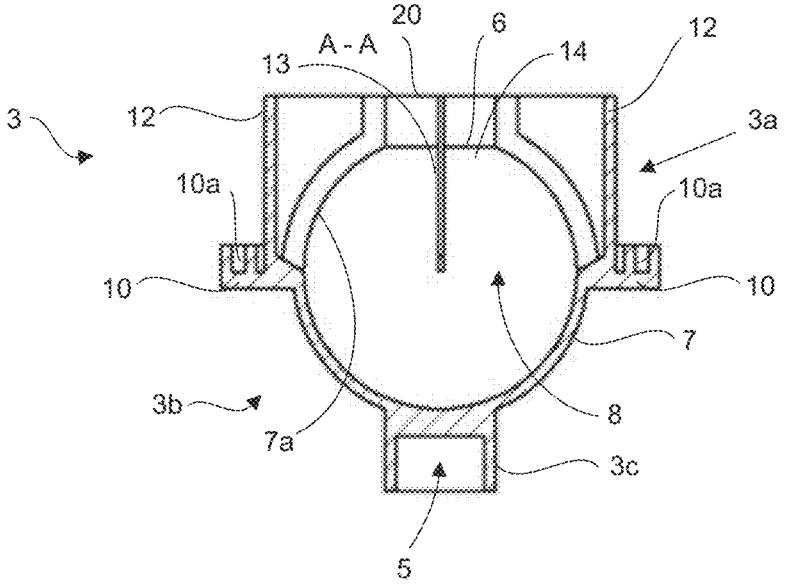
FIG. 3 a sectional view of a moulding element according to one embodiment.
Figure 4:
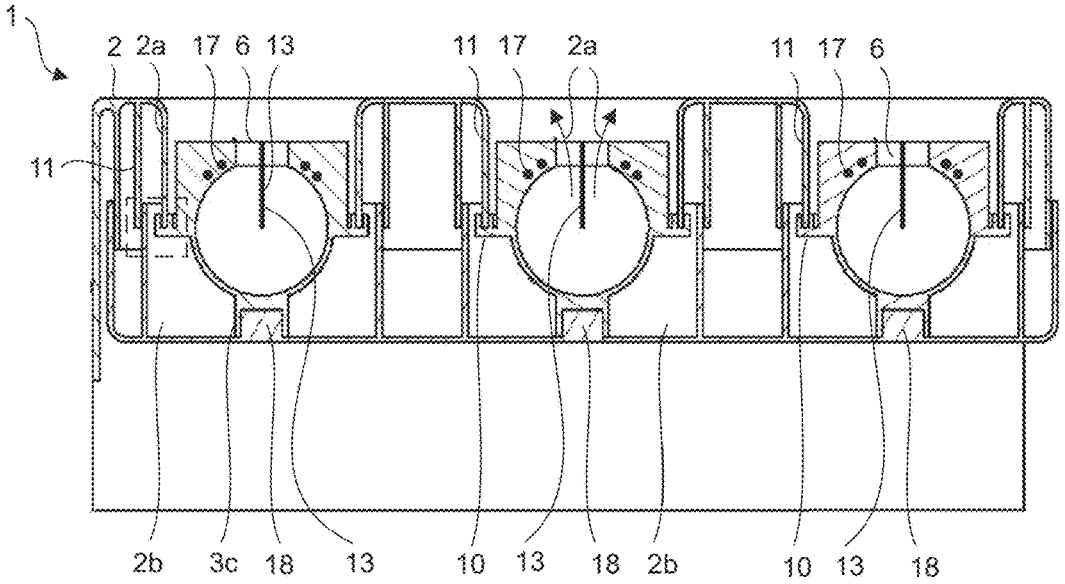
FIG. 4 a sectional view of a receiving device with a moulding element according to one embodiment.
Figure 4A:
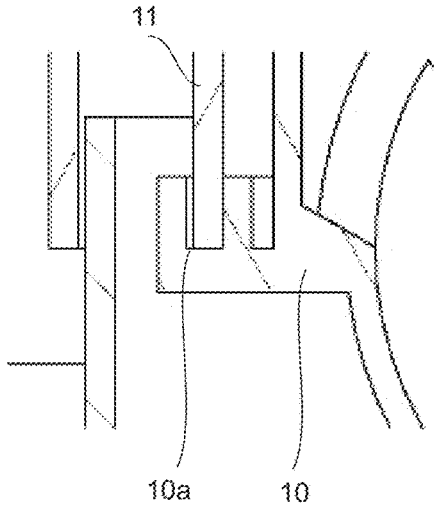
FIG. 4*a* a detailed view from FIG. 4.
Figure 5:
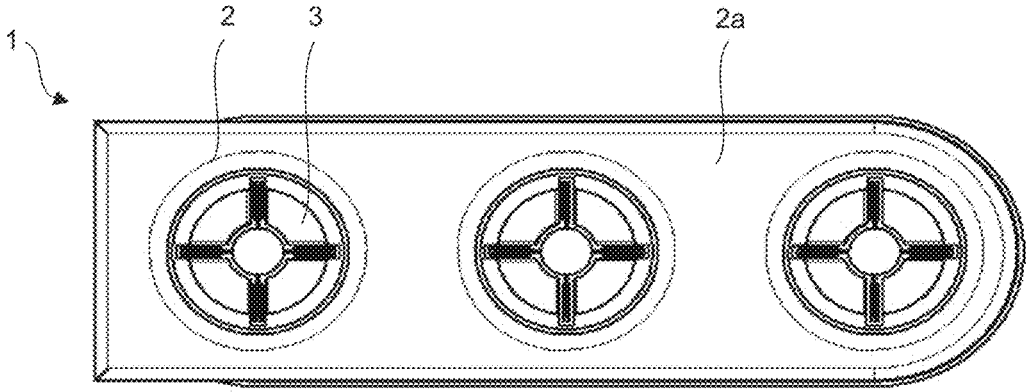
FIG. 5 a top view of a receiving device with a moulding element according to one embodiment.
Figure 6:
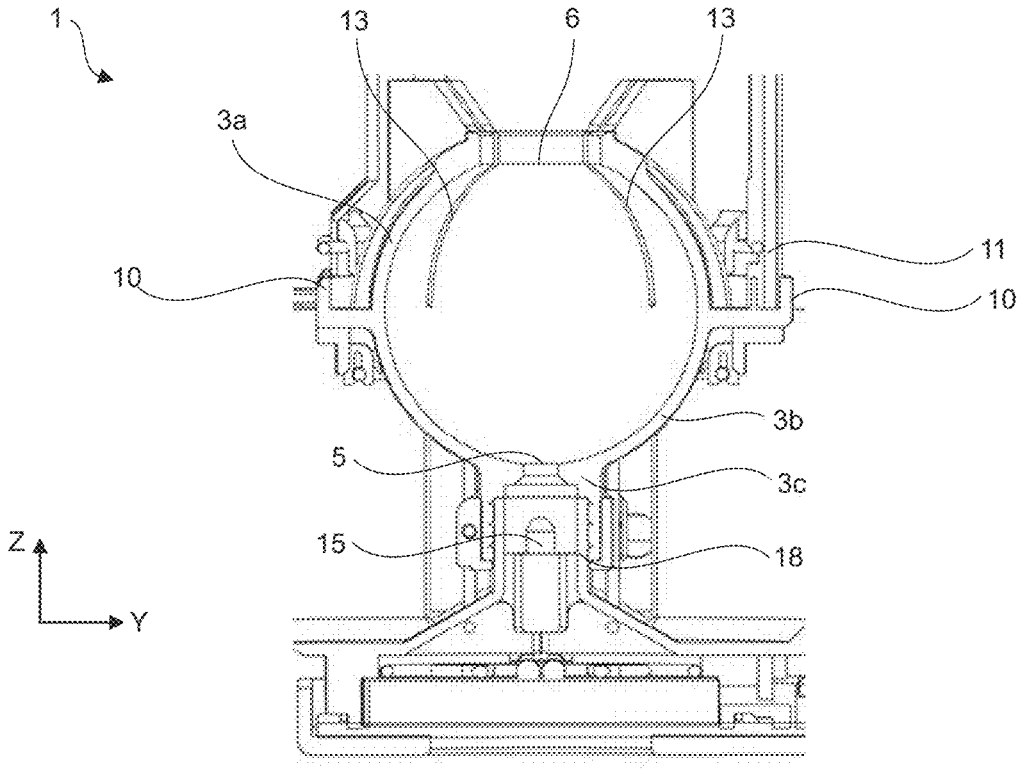
FIG. 6 a sectional view of a receiving device with a moulding element according to one embodiment.

In FIGS. 1-3, only the at least one moulding element 3 is shown. In the remaining figures, an ice-making device 1 with at least one moulding element is shown at least in part. The ice-making device 1 can comprise any number of moulding elements 3. The number of moulding elements 3 depends on the desired number of ice pieces to be prepared. FIGS. 4 and 5, for example, show an ice-making device 1 which can provide three essentially spherical ice pieces 4 and thus comprises three moulding elements 3. However, this number is not to be understood as a limitation of the generality.

The at least one moulding element 3 comprises a wall element 7, which encloses a receiving space 8. The receiving space 8 is suitable and intended for forming an ice piece 4. The ice piece 4 can be essentially spherical or essentially in the form of an ellipsoid or essentially in the form of a polyhedron. Of course, any other shape of the ice piece 4 is conceivable. In the figures and in the following, reference is made to an essentially spherical shape of the ice piece 4 and a correspondingly designed moulding element 3. However, this is not to be understood as a limitation of the generality.

Figure 8:
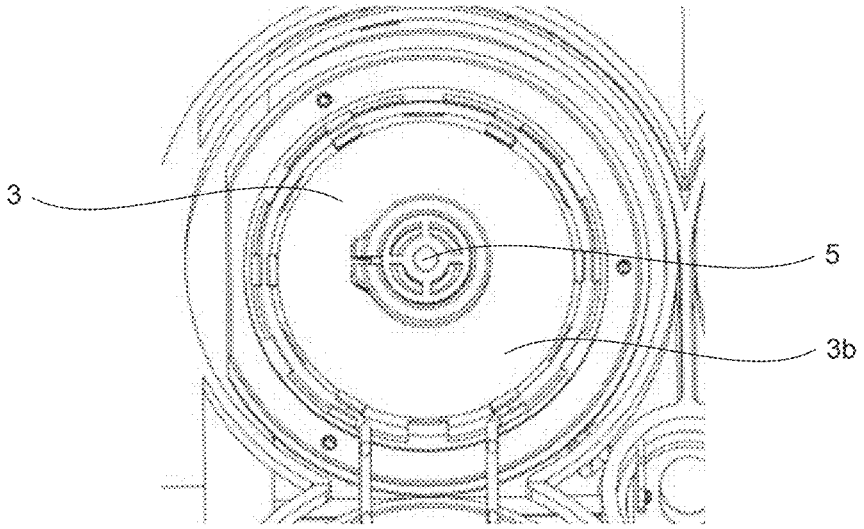
FIG. 8 a top view from below of a receiving device with a moulding element according to one embodiment.

The at least one moulding element 3 comprises an inlet opening 5, for example shown in FIGS. 8 and 3. The liquid, which is usually water, enters the at least one moulding element 3 through this inlet opening 5. The inlet opening 5 is diametrically opposite the ejection opening 6. As already explained, the at least one moulding element 3 extends along the height axis Z. The inlet opening 5 is arranged along the height axis Z below the ejection opening 6.

Furthermore, the inlet opening 5 is fluidically connected to a liquid supply device 9. It is conceivable that at least one valve device is provided which only allows a flow of liquid to or into the at least one moulding element 3 but prevents a flow of liquid from the at least one moulding element 3. Such a valve device can be integrated in the at least one moulding element 3 and/or in the receiving device 2 and/or in the liquid supply device 9.

The at least one moulding element 3 comprises an access section 3*c*, which is hollow-cylindrical in shape. This access section 3*c* surrounds the inlet opening 5 and projects away from the inlet opening 5 along the height axis Z. The access section 3*c* sits on a receiving element 18, which is cylindrical in shape. The liquid supply device 9 is also arranged at least partially inside the receiving element 18.

The at least one moulding element 3 is filled with liquid along the height axis Z. The at least one moulding element 3 is completely filled with liquid (i.e., up to the ejection opening 6). After filling, the liquid freezes (i.e., the liquid changes to a solid state). A corresponding cooling device or a cooling supply device is provided for this purpose.

The at least one moulding element 3 further comprises a retaining element 10, which can be formed entirely by the wall element 7 or arranged on the moulding element 3. The at least one holding element 10 is non-positively and/or positively connected to at least one counter-holding element 11 of the receiving device 2. In the figures, the holding element 10 is formed circumferentially along the circumference. The retaining element 10 is designed as a ring-like element that comprises a circumferential retaining groove 10*a*. The counter-holding element 11, which is designed as a retaining projection, engages in this retaining groove 10*a*.

The holding element 10 is arranged substantially centrally along the extension along the height axis Z of the at least one moulding element 3. The at least one moulding element 3 comprises a first section 3*a*, which is arranged along the height axis Z above the holding element 10. Furthermore, the at least one moulding element 3 comprises a second section 3*b*, which is arranged along the height axis Z below the holding element 10. The second section 3*b* merges into the access section 3*c*.

The first section 3*a* of the at least one moulding element 3 comprises at least two expansion elements 12 formed in a fold-like manner. Preferably, the first section 3*a* comprises at least three expansion elements 12 formed in a fold-like manner. Further preferably, the first section 3*a* comprises at least four expansion elements 12 formed in a fold-like manner. According to the embodiments shown in the figures, exactly four expansion elements 12 formed in a fold-like manner are provided. The number of expansion elements 12 depends on the selected shape of the ice piece or the negative shape of the receiving space 8 of the at least one moulding element 3. In the present case, an essentially spherical ice piece 4 is present. At least three, preferably four, fold-like expansion elements 12 are provided for such an ice piece. The expansion elements 12 serve to enable the ejection opening 6 to be enlarged. The fold-like expansion elements 12 extend along the height axis Z, starting from the at least one holding element 10, at least up to a level 14 in which the ejection opening 6 is arranged and is formed by the wall element 7.

The wall element 7 comprises slot-like openings 13. One such slot-like opening 13 is arranged in the radial direction within a fold-like expansion element 12. The wall element 7 has an inner region 7*a*, which encloses the receiving space 8 and thus determines the shape of the ice piece 4. This inner area 7*a* is interrupted by the slot-like openings 13. In a first state, which comprises the introduction of the liquid and the transition to the solid aggregate state or the frozen state, the slot-like openings 13 are closed by the elasticity of the material of the wall element 7 or the moulding element 3. The slot-like openings 13 can only be opened or spread apart by the application of force. In the aforementioned first state, the slot-like openings 13 therefore have no influence on the absorption of the liquid or the formation of the ice piece 4.

Figure 7:
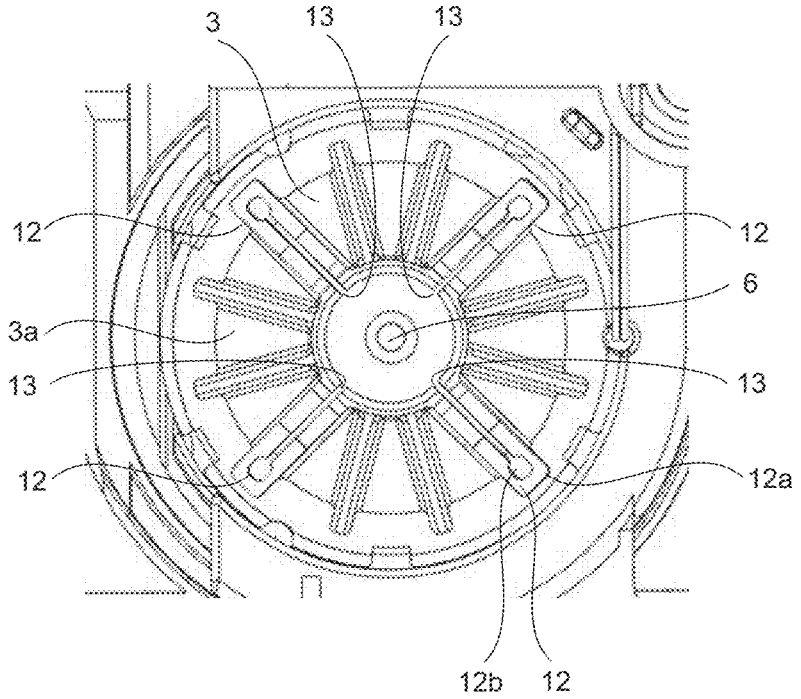
FIG. 7 a top view of a receiving device with a moulding element according to one embodiment.

According to the embodiments shown in FIGS. 1 to 3 and FIG. 7, the fold-like expansion elements 12 are essentially rectangular in shape. Of course, other embodiments, for example a triangular embodiment, are conceivable. The fold-like expansion elements 12 comprise wall elements 12*a*, which enclose an inner space 12*b*. This can be essentially rectangular in shape. The embodiment according to FIG. 7 shows an inner space 12*b* formed in two parts, with a narrow front section and a wider rear section.

As can be seen in FIGS. 1-3, a collar element 19 is provided at the distal end of the at least one moulding element 3. The collar element 19 encloses the ejection opening 6. Furthermore, the collar element 19 has a height extension starting from the ejection opening 6. The collar element 19 thus creates an upper ejection opening 20, which extends parallel to the ejection opening 6 and preferably also has the same diameter as the ejection opening 6. The fold-like expansion elements 12 extend along the height axis Z starting from the at least one holding element 10 up to a level in which the upper ejection opening 20 is arranged. Furthermore, the fold-like expansion elements 12 are integral with the collar element 19. The wall thickness of the collar element 19 essentially corresponds to the wall thickness of the wall elements 12*a* of the fold-like expansion elements 12. Furthermore, the slot-like openings 13 are also continued in the collar element 19.

Furthermore, an ejection element 15 is provided. An ejection force 16 along the height axis Z can be applied to the at least one moulding element 3 and/or the ice piece 4 by the ejection element 15. The ejection force 16 causes a piece of ice 4 located in the at least one moulding element 3 to be displaced upwards along the height axis Z. The ejection element 15 can have a pin-like design and be arranged inside the receiving element 18.

When the ice piece 4 is ejected, the ejection element 15 contacts the at least one moulding element 3, whereby the ejection force 16 acts on the second section 3*b* of the at least one moulding element 3. The engagement of the counter-holding element 11 in the holding element 10 prevents the at least one moulding element 3 from being displaced or changed in position. Accordingly, the second section 3*b* of the at least one moulding element 3 is deformed by the expressive force 16. Furthermore, the ice piece 4 is displaced upwards along the height axis Z. Alternatively, it would also be possible for the ejection element 15 to be displaced through the inlet opening 5 and for the ejection force 16 to be applied directly to the ice piece 4. However, the first-mentioned alternative has the advantage that the ice piece 4 cannot be damaged by the ejection element 15.

By displacing the ice piece 4 upwards along the height axis Z, the ejection force 16 also acts on the first section 3*a* of the at least one moulding element 3, whereby the slot-like openings 13 are spread apart. The entire first section 3*a* and, in particular, the ejection opening 6 can be enlarged by the pleat-like expansion elements 12, so that the ice piece 4 can be removed from the at least one moulding element. In FIG. 4, arrows 21 are shown which represent the opening direction of the at least one moulding element 3.

Figure 9:
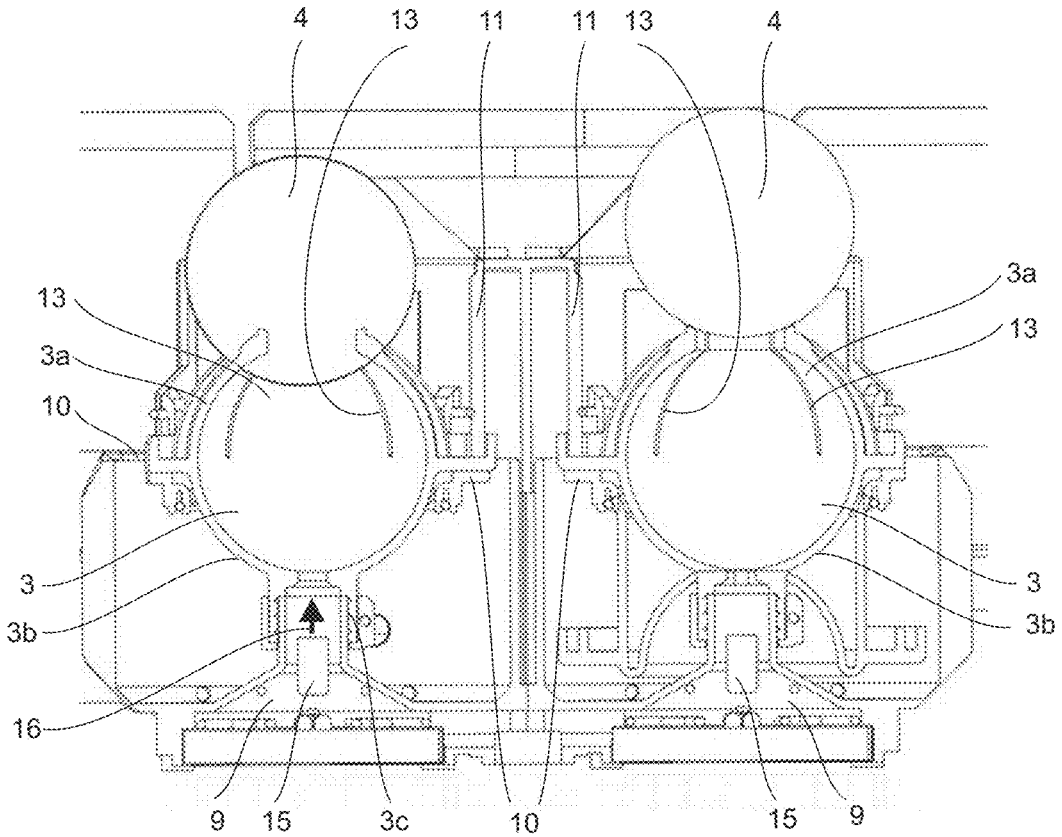
FIG. 9 a sectional view of a receiving device with a moulding element according to one embodiment.

FIG. 9 also shows the ejection of the ice piece 4. In the left moulding element 3, the ice piece 4 has already partially emerged from the moulding element 3. The first section 3*a* is stretched and the ejection opening 6 is enlarged. In the left-hand moulding element 3, the ice piece 4 has already completely emerged from the moulding element 3. After the ice piece 4 has left the at least one moulding element 3, the wall element 7 of the at least one moulding element 3 shifts back to its original shape, so that the at least one moulding element 3 is back in its original shape and a new cycle with filling can be carried out.

The elastic material of the at least one moulding element 3 must therefore be designed in such a way that it has sufficient elasticity or stiffness to allow the moulding element 3 to return to its original shape. Furthermore, the elastic material must retain such elasticity even when exposed to cold temperatures, preferably down to −30° C. Finally, the elastic material must be approved for use with foodstuffs.

The ejection element 15 is part of an ejection device 22. The ejection device 22 can be controlled in such a way that only one ice piece 4 is ejected or that several or even all ice pieces are ejected simultaneously.

Furthermore, at least one heating element 17 is arranged on the first section 3*a* of the at least one moulding element 3. This is shown in FIG. 4. Such a heating element 17 may be, for example, a resistance wire, a fan heater, or the like. The at least one heating element 17 can be activated before and/or during dispensing of the ice piece 4. Preferably, the heating element 17 is activated shortly before ejection in order to release the ice piece 4 from the at least one moulding element 3 and to allow the slot-like openings 13 to spread smoothly.

The receiving device 2 comprises an upper section 2*a*, in which the first section 3*a* of the at least one moulding element 3 is arranged. This upper section 2*a* is dimensioned in such a way that the first section 3*a* of the at least one moulding element 3 can be enlarged. Furthermore, a lower section 2*b* is provided, in which the receiving element 18 is arranged.

Figure 10:
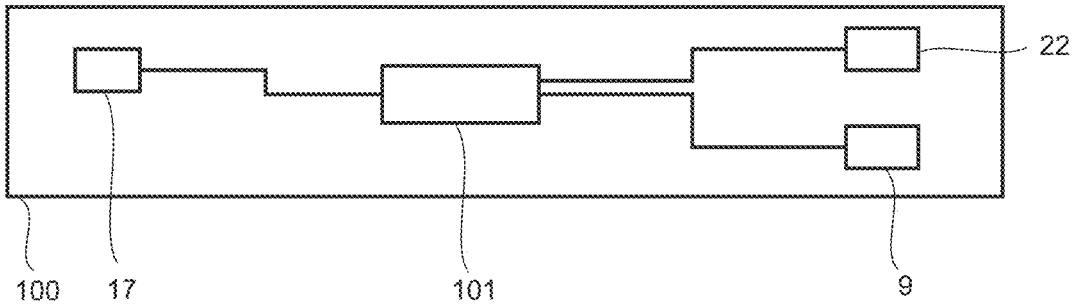
FIG. 10 a schematic circuit diagram.

The household appliance 100 comprises a control device 101, which is connected to the ejection device 22, the liquid supply device 9 and the heating element 17 by means of signalling technology and controls the aforementioned components accordingly. This is shown in FIG. 10.

The applicant reserves the right to claim all features disclosed in the application documents as being essential to the invention, provided that they are new compared to the prior art, either individually or in combination. It should also be noted that the individual figures also describe features which may be advantageous in themselves. The skilled person immediately recognises that a particular feature described in a figure can also be advantageous without the adoption of further features from this figure. Furthermore, the skilled person recognises that advantages can also result from a combination of several features shown in individual figures or in different figures.

LIST OF REFERENCE SYMBOLS

1 Ice-making device
2 Receiving device
2*a* Upper section
2*b* Lower section
3 Moulding element
3*a* First section of the moulding element
3*b* Second section of the moulding element
3*c* Access section
4 Ice piece
5 Inlet opening
6 Ejection opening
7 Wall element
7*a* Inner region/area
8 Receiving space
9 Liquid supply device
10 Holding element
10*a* Groove
11 Counter-holding element
12 Expansion element
12*a* Wall element of the expansion element

12*b* Inner space
13 Slot-like opening
14 Level
15 Ejection element
16 Ejection force
17 Heating element
18 Receiving element
19 Collar element
20 Upper ejection opening
21 Arrows
22 Ejection device
100 Household appliance
101 Control device
X Longitudinal axis
Y Width axis
Z Height axis

What is claimed is:

1. An ice-making device comprising a receiving device for receiving at least one moulding element which is suitable and intended for moulding an ice piece, characterized in that the at least one moulding element is designed in one piece and consists of an elastic material, wherein the at least one moulding element comprises an inlet opening for introducing a liquid and an ejection opening for ejecting the ice piece, wherein the elastic material is of sufficient elasticity to allow the moulding element to return to an original shape after ejection.

2. The ice-making device according to claim 1, characterized in that the at least one moulding element comprises a wall element which encloses a receiving space, the receiving space being suitable and intended for forming the ice piece which is essentially spherical or essentially in the form of an ellipsoid or essentially in the form of a polyhedron.

3. The ice-making device according to claim 1, characterized in that the at least one moulding element extends along a height axis, wherein the inlet opening of the at least one moulding element lies diametrically opposite the ejection opening of the at least one moulding element, wherein the inlet opening of the at least one moulding element lies along the height axis below the ejection opening of the at least one moulding element, wherein the inlet opening of the at least one moulding element can be fluidically connected to a liquid supply device.

4. The ice-making device according to claim 1, characterized in that at least one holding element is provided, which is arranged on the at least one moulding element or is formed by the wall element of the at least one moulding element, wherein the at least one holding element is connected in a force-fitting and/or form-fitting manner to at least one counter-holding element of the receiving device.

5. The ice-making device according to claim 4, characterized in that the at least one holding element is arranged along a circumference of the wall element, wherein the at least one holding element is arranged at least partially circumferentially along a circumference of the wall element, wherein a first section of the at least one moulding element is arranged along the height axis above the at least one holding element and a second section is arranged along the height axis below the at least one holding element, wherein the at least one holding element is arranged along the height axis substantially centrally with respect to an extension of the at least one moulding element.

6. The ice-making device according to claim 5, characterized in that the first section of the at least one moulding element comprises at least two fold expansion elements, wherein the at least two fold expansion elements enable the ejection opening to be enlarged, wherein the wall element has a slot opening in each of the at least two fold expansion elements, wherein in a first state the at least two slot openings are sealingly closed.

7. The ice-making device according to claim 6, characterized in that the at least two fold expansion elements extend along the height axis, starting from the at least one holding element, at least up to a level in which the ejection opening is arranged, wherein the at least two fold expansion elements are formed by the wall element.

8. The ice-making device according to claim 1, characterized in that an ejection element is provided, by means of which an ejection force can be applied along a height axis to the at least one moulding element and/or the ice piece, wherein a piece of ice located in the at least one moulding element can be displaced along the height axis by the ejection force, wherein displacement of the ice piece along the height axis causes the at least two slot openings to spread.

9. The ice-making device according to claim 1, characterized in that the elastic material of the at least one moulding element is a silicone.

10. The ice-making device according to claim 5, characterized in that at least one heating element is provided on the first section of the at least one moulding element, wherein the at least one heating element can be activated before and/or during the ejection of the ice piece.

11. A household appliance comprising the ice-making device according to claim 1.

* * * * *